US007618004B2

(12) United States Patent
Gelli et al.

(10) Patent No.: US 7,618,004 B2
(45) Date of Patent: Nov. 17, 2009

(54) MULTIFUNCTION UNWINDING DEVICE

(75) Inventors: Mauro Gelli, Lucca (IT); Romano Maddaleni, Pisa (IT); Roberto Morelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 310 days.

(21) Appl. No.: 11/579,584

(22) PCT Filed: May 3, 2005

(86) PCT No.: PCT/IT2005/000256

§ 371 (c)(1),
(2), (4) Date: Dec. 7, 2006

(87) PCT Pub. No.: WO2005/108255

PCT Pub. Date: Nov. 17, 2005

(65) Prior Publication Data

US 2008/0258001 A1 Oct. 23, 2008

(30) Foreign Application Priority Data

May 7, 2004 (IT) ..... FI2004A0108

(51) Int. Cl.
*B65H 19/18* (2006.01)

(52) U.S. Cl. ..... 242/555; 242/555.3; 242/555.4

(58) Field of Classification Search ..... 242/552, 242/554, 554.2, 554.4, 555, 555.3, 555.4, 242/555.7, 556
See application file for complete search history.

(56) References Cited

U.S. PATENT DOCUMENTS

| | | | | |
|---|---|---|---|---|
| 3,856,227 | A | 12/1974 | Gouy | |
| 3,896,820 | A | 7/1975 | Ludszeweit et al. | |
| 4,579,293 | A | 4/1986 | Steiniger | |
| 4,676,447 | A * | 6/1987 | Zald et al. | 242/420.3 |
| 4,848,691 | A * | 7/1989 | Muto et al. | 242/553 |
| 5,190,234 | A * | 3/1993 | Ezekiel | 242/552 |
| 5,273,228 | A * | 12/1993 | Yoshida et al. | 242/552 |
| 5,308,007 | A * | 5/1994 | Stroszynski | 242/555.4 |
| 5,322,230 | A | 6/1994 | Dylla et al. | |
| 5,411,223 | A * | 5/1995 | Gatteschi | 242/551 |
| 5,514,237 | A * | 5/1996 | Emenaker et al. | 156/159 |
| 5,699,978 | A * | 12/1997 | Hanazawa | 242/552 |
| 5,762,283 | A | 6/1998 | Buchmeyer et al. | |
| 5,906,333 | A | 5/1999 | Fortuna et al. | |
| 6,030,496 | A | 2/2000 | Baggot et al. | |
| 6,547,909 | B1 * | 4/2003 | Butterworth | 156/157 |
| 6,941,994 | B2 | 9/2005 | Kushihashi et al. | |

(Continued)

FOREIGN PATENT DOCUMENTS

EP 0 872 440 A2 10/1998

(Continued)

*Primary Examiner*—Sang Kim
(74) *Attorney, Agent, or Firm*—Breiner & Breiner, LLC

(57) ABSTRACT

The unwinding device to unwind reels of web material includes: unwinding members to simultaneously unwind a first reel and a second reel; a splicing device to join together a first web material coming from the first reel and a second web material coming from the second reel; at least one accumulation member to accumulate the web material delivered from the second reel before splicing with the web material delivered from the first reel; a first path and a second path for the web material delivered simultaneously from the first and from the second reel towards a machine downstream.

22 Claims, 13 Drawing Sheets

U.S. PATENT DOCUMENTS 6,978,816 B1 * 12/2005 Byrne et al. ..... 156/504

FOREIGN PATENT DOCUMENTS

| | | | |
|---|---|---|---|
| EP | 1 136 406 | A2 | 9/2001 |
| EP | 1 270 470 | A2 | 1/2003 |
| EP | 1 332 995 | A1 | 8/2003 |
| GB | 2 135 283 | A | 8/1984 |
| WO | WO 95/34497 | A1 | 12/1995 |
| WO | WO 98/46509 | A1 | 10/1998 |
| WO | WO 00/56644 | A1 | 9/2000 |

* cited by examiner

MULTIFUNCTION UNWINDING DEVICE

TECHNICAL FIELD

The present invention relates to an unwinding device to unwind reels of web material wound around a central axle to deliver web material to a converting or processing line.

PRIOR ART

In many industrial applications it is necessary to feed a web material to a production line, which is unwound from a reel or from several reels in parallel. Typically, feed of web material is required in the paper industry. For example, to produce paper napkins, rolls of toilet paper, rolls of kitchen towel or the like converting lines are provided wherein a web material is delivered from a reel with a large diameter and a high axial dimension to a series of downstream stations, at the end of which the finished product is obtained. In the case of rolls of toilet paper or similar products, the web material is delivered from one or more parent reels of large diameter and wound in rolls or logs of a smaller diameter, which are subsequently cut orthogonal to the axis thereof to obtain small finished rolls. In some cases the web material delivered from the reel or reels of large diameter is cut longitudinally to form in parallel a plurality of small rolls of smaller height, i.e. with a smaller axial extension.

In the case of napkin production, web material is delivered from one or more reels with a large diameter and, optionally cut into longitudinal strips, folded longitudinally and cut and folded crosswise.

The production of rolls, napkins or other articles takes place at high speed and continuously and requires periodic replacement of the large reels as they expire. In many cases it is necessary to halt the production line or drastically reduce the speed to allow the expired reels to be replaced with new reels. This operation reduces the overall productivity of the line with evident disadvantages in economic terms. There is therefore the need to produce unwinding devices, which allow rapid and reliable replacement of expired reels with new reels. These devices must also perform splicing, that is, joining of the web materials from consecutive reels, in order to obtain a substantial continuity of the web material delivered to the production line downstream. The spliced area of the web material is normally discarded. When the line produces rolls, the spliced area is in a roll or log which is subsequently discarded and recycled.

WO-A-9534497 describes an unwinding device, which allows automatic, rapid and reliable splicing respectively of two web materials from an expired reel and a new replacement reel. In this arrangement a shuttle or carriage is provided, which moves alternatively from a loading station to an unwinding station, to each time transfer a reel from the loading station to the unwinding station and to remove the expired tubular core from the winding area towards an unloading area. The shuttle is provided with means to prepare and retain the initial free end of the web material wound on the reel located on said shuttle. A cutting member and a retaining member are provided in the unwinding station to create a free end of the web material delivered from the previous reel being delivered and to retain this free end to be subsequently spliced with the initial free end of the web material of the reel inserted in the unwinding station by the shuttle.

Although the splicing operation is made particularly rapid by the innovative arrangement of the splicing and cutting means described in this publication it is still necessary to stop delivery of the web material in order to replace the expired reel with a new reel.

WO-A-0056644 describes a further unwinding device, which can use the same type of mechanism to splice two web materials coming from two subsequent reels. Also in this case the reels are replaced after feed of the web material to the production line downstream has been stopped. Although it is possible for a certain amount of web material to accumulate from the unwinder to the production line, for example using a festoon accumulator, this is not always advisable due to the characteristics of the web material, which may not have a particularly high tensile strength, or in view of the high speed of the production line, which would require an extremely large accumulator. Moreover, the winding path defined by the festoon causes fibers to detach from the web material, especially when it is made of tissue paper, with the consequent production of dust and deterioration of the characteristics of the finished product.

EP-A-1136406 describes an unwinder with a shuttle which translates the reels from one or other of two loading and unloading positions to an intermediate unwinding position. The shuttle has motorized tail chucks to unwind the reel. Replacement of an expired reel with a new reel requires feed to be stopped.

Studies have been attempted to produce an unwinder, which allows automatic replacement of the reels at speed, without stopping delivery of the web material to the converting or production line downstream of the unwinder. Examples of unwinders which should function continuously are described in U.S. Pat. No. 5,906,333, U.S. Pat. No. 6,030,496, EP-A-1,270,470, EP-A-0872440, WO-A-9846509. These publications describe an unwinder wherein in the delivery phase the reel is supported by a pair of oscillating arms. When the reel is about to expire, the arms place it on a cradle formed by two rollers, one of which is motorized, to continue rotation of the reel and consequent delivery of the web material. Subsequently, the pair of oscillating arms picks up a new reel from a shuttle and starts to unwind the initial end with the aid of a suction belt. The initial free end of the new reel is dropped on top of the web material being unwound from the first reel, which has almost expired. Contact between the two web materials should cause drawing of the initial free end of the web material wound around the second reel and the feed thereof together with the first web material to reach a nip formed by two embossing or laminating cylinders, which should perform splicing of the two plies.

Operation of this unwinding device is extremely uncertain as in the initial, most critical phase of feeding the new web material, drawing is entrusted to mere contact between two extremely light materials. There is nothing to guarantee that the web material coming from the new reel will effectively follow the path defined by the first web material coming from the expiring reel. Moreover, as splicing of the two plies must take place when they have the same feed speed, the cylinders, which perform splicing, must be arranged at a considerable distance from the reel unwinding area. In fact, a considerable quantity of web material is unwound from the new reel during the acceleration phase before reaching the same speed as the speed of the material coming from the first reel. The distance between the reel and the splicing cylinders must be at least the same as the length of the web material wound in this acceleration phase. The position of the cylinders which perform splicing of the two web materials must be in the position in which the head of the second web material is located at the time of splicing and not farther back, as otherwise the head of the web material would remain free and would accidentally wind around one or the rollers of the production line, thereby jamming the entire production line.

Prior art unwinders can be classified as unwinders which perform automatic splicing of the expiring reel with a reel standing by, or which stop feed of the web material from an expiring reel and allow replacement of said reel, after having cut the web material, splicing the head and tail of the web materials with the machine stopped.

OBJECTS AND SUMMARY OF THE INVENTION

The object of the present invention is to produce an unwinding device which allows an expired reel to be replaced reliably with a new reel at speed, that is, by making the new reel rotate at a suitable peripheral speed, typically the same as the speed of the expiring reel, before splicing the two web materials and which also allows conventional operation, that is, replacement of the expired reel with a new reel and splicing of the tail and head of the web material in static conditions, allowing the operator to choose the required operating mode.

Essentially, according to the invention an unwinding device is provided to unwind reels of web material, comprising: unwinding members to simultaneously unwind a first reel and a second reel; a splicing device to join together a first web material coming from said first reel and a second web material coming from said second reel; at least one accumulation member to accumulate the web material delivered from said second reel before splicing with the web material delivered from said first reel; a first path and a second path for the web material delivered simultaneously from said first and from said second reel towards a machine downstream.

With a configuration of this type it is possible to use the unwinding device in automatic or semi-automatic mode to splice the web material of an expiring reel with the web material of a second reel standing by. For this purpose the second reel is angularly accelerated until the peripheral speed thereof is at the same value as the feed speed of the web material coming from the first reel, said feed speed which may have been temporarily at least partly reduced with respect to the normal operating speed. When the two speeds are essentially the same, the two web materials are spliced. The accumulation member is used to temporarily accumulate the web material delivered from the second reel during the angular acceleration phase.

The presence of a double path for the web material allows the unwinding device also to function as a conventional double unwinding device, wherein delivery stops when a reel expires, the cut web material retaining the tail of said material, and a new reel is inserted. Subsequently, by means of a manual operation, the head of the web material of the new reel is spliced to the tail of the expired material and feed is restarted.

This makes the device very flexible, allowing the user to choose the most suitable type of operating mode for different circumstances, also as a function of the number of plies that the product obtained by processing the web materials delivered by the unwinding device is to be composed of.

According to another aspect, the invention relates to an unwinding device to unwind reels of web material comprising:

- unwinding members to unwind a first reel and a second reel;
- a splicing device to join together a tail end of a web material coming from said first reel and a head end of a web material coming from a second reel;

characterized by control means which control rotation of said first and said second reel to unwind said reels simultaneously for the entire unwinding operation or, alternatively, only during an initial reel changing phase, during which the second reel is made to rotate at a speed suitable for reciprocal splicing of the web material of the first and of the second reel using said splicing device.

If the device is used as a conventional unwinder, control means, for example comprising a processor with one or more management programs residing therein, are used to control that when a reel expires it is stopped and replaced with another one and the tail of the web material of the expired reel is spliced to the head of the new reel before restarting feed. In this case, two reels may be present simultaneously on the unwinding members and unwound in parallel, thereby rotating simultaneously delivering the web material concurrently for the entire unwinding cycle.

On the other hand, the two reels carried by the unwinding members can be unwound in sequence, performing automatic splicing of the tail end of the web material of the first reel and the head end of the material of the second reel at speed, with an intermediate and transitory phase wherein the second reel, being taken to the correct speed for change-over, delivers the web material in parallel to the first reel, but towards an accumulation member rather than towards the converting line.

Further advantageous characteristics and embodiments of the device according to the invention are indicated in the appended claims and shall be described in greater detail with reference to an example of embodiment.

BRIEF DESCRIPTION OF THE DRAWINGS

The invention shall now be better understood by following the description and accompanying drawing, which shows a non-limiting practical example of the invention. In the drawing.

DETAILED DESCRIPTION OF THE EMBODIMENT OF THE INVENTION

Figure 1:
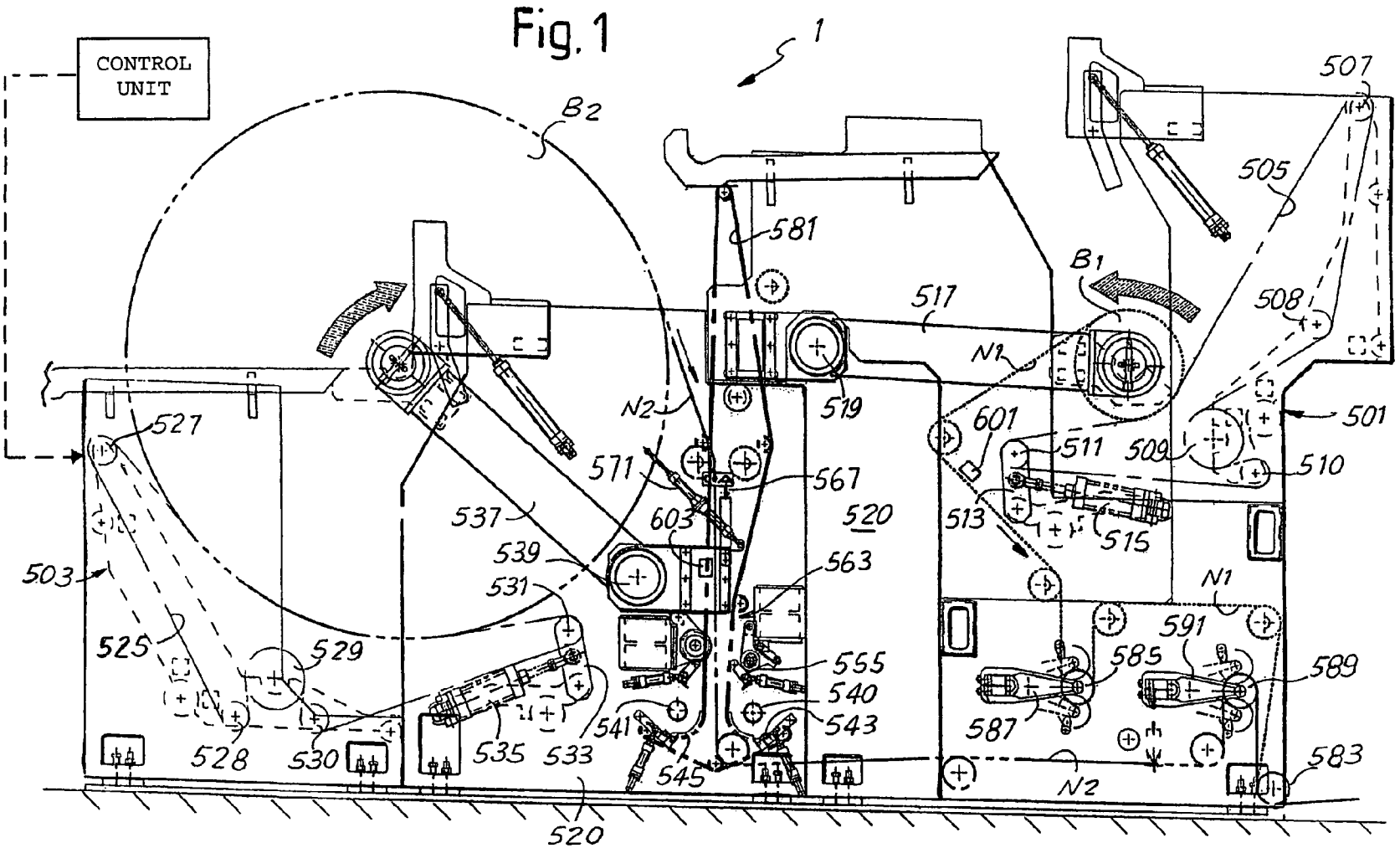
FIGS. 1 and 2 schematically show the device in a first operating mode.

The device will be initially described in the complete structure thereof with reference to FIGS. 1 to 3 and subsequently two operating methods will be illustrated with reference to FIGS. 1 and 2 and to FIGS. 4 to 7 respectively.

In general, the unwinding device, indicated as a whole with 1, comprises a first unwinding member 501 and a second unwinding member 503 to unwind, simultaneously or in succession, two reels indicated with B1 and B2 in the drawing. The web material unwound from the reel B1 is indicated with N1 while the web material unwound from the reel B2 is indicated with N2. The unwinding member 501 comprises a system of belts 505 driven around pulleys 507, 508, 509, 510, 511. The pulley 509 is motorized while the pulley 511 is supported by an oscillating arm 513 operated by a piston-cylinder actuator 515, which holds the belt 505 in tension against the surface of the reel B1. Said reel is supported by a pair of arms 517 hinged in 519 to the load-bearing structure 520. The arms 517 are gradually lowered to maintain the reel B1 in contact with the unwinding belt 505. The oscillating movement of the arms 517 and of the pulley 511 by means of the oscillating arm 513 are known per se and not described in greater detail herein. In any case the movement is such that the belt 505 is always held sufficiently in tension to draw the reel B1 in rotation by means of the motor, which operates the motorized pulley 509.

An analogous arrangement is provided for the unwinding member 503, which comprises an unwinding belt 525 driven around pulleys 527, 528, 529, 530, 531. The pulley 529 is motorized, while the pulley 531 is supported by an oscillating arm 533 operated by a piston-cylinder actuator 535 equivalent to the actuator 515. The reel B2 is supported by a pair of oscillating arms 537 hinged in 539 to the load-bearing structure 520.

Disposed between the two unwinding members 503 and 501 are means to automatically splice the web material coming from the expiring reel with the web material coming from the new reel standing by while they are moving. Greater details of the operating sequence of these splicing means will be described with reference to FIGS. 4 to 7 hereunder. The arrangement of these members can be seen in particular in FIG. 3. They comprise winding cores, indicated with 540 and 541. As shall be explained hereunder, when the device is used in automatic splicing mode of the web materials, in the acceleration phase the first portion of material of the new reel is accumulated on these cores by winding. They thereby form two accumulation members.

Pressure members 543 and 545 carried by oscillating arms 547 and 549 controlled by piston-cylinder actuators 551 and 553, are associated with the cores 540 and 541. These members are used to press the initial free end of the web material N1 or N2 to the core 540 or 541 and make it adhere thereto, said core having been for this purpose provided with a strip of double-sided adhesive material. The cores 540 and 541 can be cardboard cores intended to be subsequently recovered together with the web material (typically paper) wound thereon, or can be formed of re-usable spindles. In any case, they are made to rotate when necessary by rotation members (not shown). Alternatively, compressed air nozzles can be used to cause the initial part of the web material to be wound around the relative core. In a further alternative, suction cores or spindles, with a perforated cylindrical wall, can be used.

Two cutting or severing members 555, 557 supported by oscillating arms and controlled by piston-cylinder actuators 559, 561, are disposed above the cores 540, 541. These cutting or severing members are used to sever the web material in the automatic change-over and splicing phase which shall be described hereunder.

A ply-bonding unit or other system to bond the web materials N1, N2, indicated as a whole with 563, known per se and not described in greater detail herein, is disposed over the severing or cutting members 555, 557.

An oscillating arm 565 supporting a further cutting or severing member 567 is disposed over the ply-bonding unit 563. The arm 565 can oscillate about an axis 569 in one direction or in the other by means of a double piston-cylinder actuator 571. The cutting or severing member 567 acts alternatively on one or other of the web materials N1, N2 during the automatic reel replacement cycle described hereunder.

A belt 581 for insertion of the head of the web material N1 or N2 when the device operates in automatic mode is also disposed in the intermediate area between the two unwinding members 501 and 503.

Figure 2:
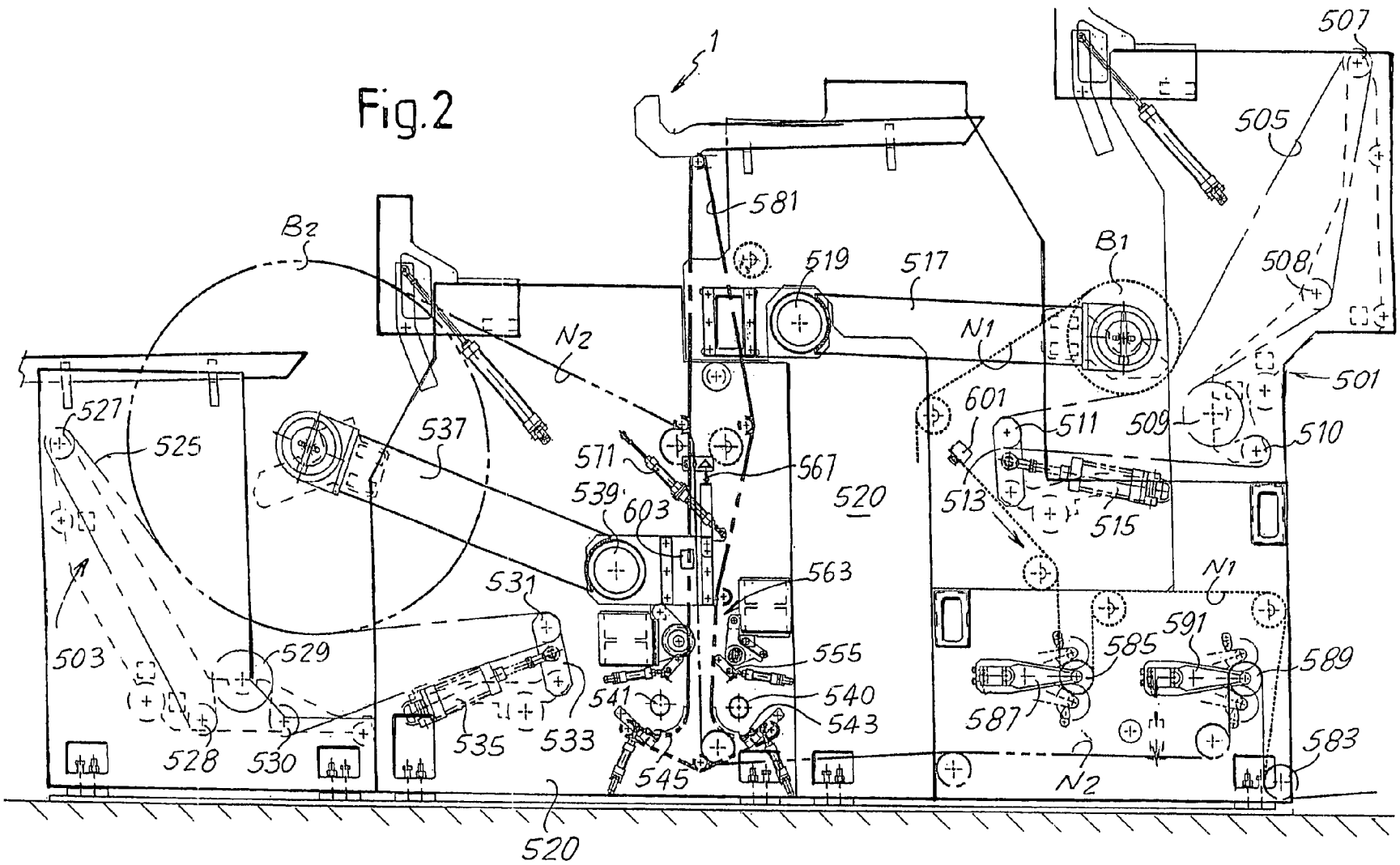
Figure 3:
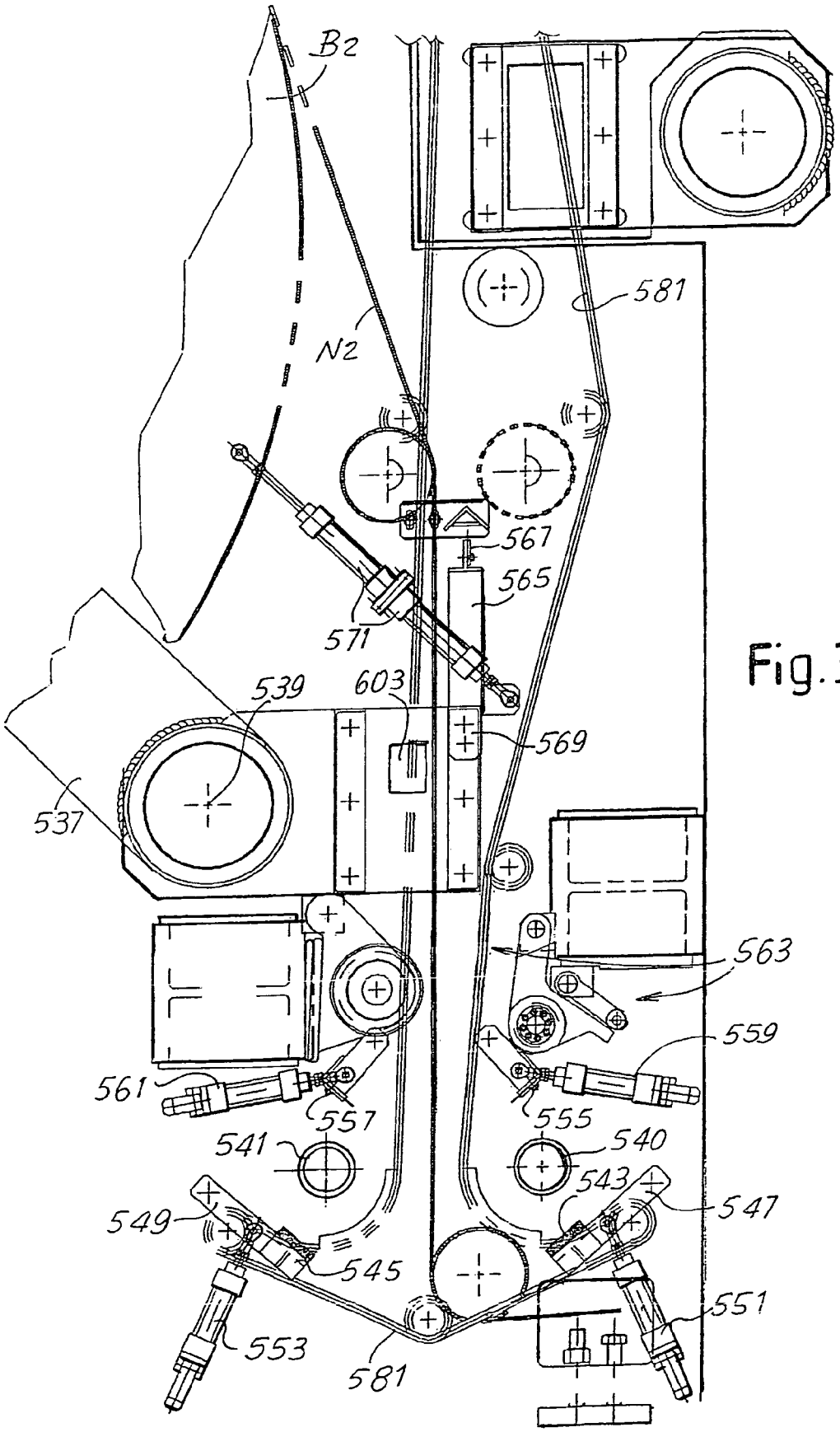
FIG. 3 shows an enlargement of the area for automatic splicing of the plies coming from two reels.

With specific reference to FIGS. 1 and 2, it can be seen that the web material N1 and/or N2 coming from the reel B1 and/or B2 is fed along a path around a return roller 583, from which one or more web materials are fed to the sections downstream of the unwinder, where these materials are converted into the finished product in various steps known per se and not described herein.

Upstream of the roller 583 in the configuration in FIGS. 1 and 2, two distinct paths are provided, respectively for the web material N1 coming from the reel B1 and for the web material N2 coming from the reel B2. Disposed along the first path of the web material N1 is a take-up roller 585, supported by an arm 587 and having the function of maintaining the tension in the web material N1 regulated, for example, according to the variation in the speed and/or to any deformations in the reel B1. An analogous take-up roller, indicated with 589 and supported by an arm 591, is provided along the path of the web material N2 coming from the reel B2. This arrangement of the paths of the two web materials N1 and N2 is used when the device operates in manual mode, that is, when splicing of the tail of the web material of an expiring reel with the head of the web material of a new reel is performed manually at the end of unwinding of the expired reel. In substance, in this configuration the device 1 behaves like a normal double unwinder in which when the reel B1 expires it is replaced with a new reel supported by the same pair of arms 517, as is the case when the reel B2 expires.

To replace the reel and splice the head and the tail of the web material in this operating mode, respective retaining members, indicated with 601 and 603, are provided, associated with the unwinding member 501 and with the unwinding member 503 respectively. These retaining members essentially comprise, for example, a cross-member, which extends orthogonally to the direction of feed of the web material N1 for the cross-member 601 and to the direction of feed of the material N2 for the cross-member 603. Optionally, mechanical clamping mechanisms (not shown and known per se) are associated with the cross-members 601 and 603 to hold the free tail end of the web material N1 or N2 against the cross-member 601 or 603 when unwinding of the respective reel terminates.

When the unwinding device 1 operates in manual mode, operation thereof is as follows, described with reference to FIGS. 1 and 2. In FIG. 1 the web material N1 coming from the reel B1 and the web material N2 coming from the reel B2 are fed simultaneously along the two separate paths which extend around the take-up rollers 585 and 589. Each of the two web materials can in turn be composed of one or more plies according to the type of reel used. The two adjacent web materials are then fed around the roller 583 and from here towards the rewinding machine or other converting machine.

In the layout in FIG. 1 it can be seen that the reel B1 has almost expired while the reel B2 is still in an initial unwinding phase. This shows that the two reels B1 and B2 can expire at different times and will therefore be replaced in different moments of the work cycle. In the layout in FIG. 1 the reel B1 has almost reached the moment of replacement with a new reel. To do this the system is temporarily stopped, stopping both the unwinding member 501 and the unwinding member 503 to allow the operator to act and replace the expired reel B1. For this purpose he will firstly clamp the material N1 on the retaining member 601 and cut the material to produce a tail end, clamped on the cross-member 601 and a head end, which remains in the position shown in FIG. 2. At this point the arms 517 are raised to unload the expired reel B1, or the remains thereof still wound on the central winding core, and to receive a new reel (not shown) which is transported to the unwinder 1, for example by means of an overhead crane or other suitable means known per se. These operations are not shown and are known to those skilled in the art.

Once the new reel has been engaged by the oscillating arms 517, they are lowered to position the new reel against the belt 505, which makes the new reel rotate slowly until the initial free end thereof is in a position in which the operator can manually perform splicing of this head with the tail of the material N1 of the previous reel, held on the cross-member 601 and previously provided with, for example, a strip of double-sided adhesive material. Once this splicing has taken place, which may be facilitated by mechanical members to splice the ends (not shown), unwinding of both reels can restart: the new reel replacing the reel B1 and the reel B2 not yet expired supported by the arms 537.

An analogous operation will take place when the reel B2 has expired. In this case the tail of the web material N2 is formed and clamped on the cross-member 603.

When the unwinding device 1 operates automatically to replace an expired reel with a new reel at speed, it performs the steps illustrated schematically in FIGS. 4 to 7 described hereunder in greater detail, using the mechanisms illustrated above with particular reference to FIG. 3. In this case the take-up roller 585 with relative arm 587 are not used and are therefore omitted from the respective figures.

Figure 4:
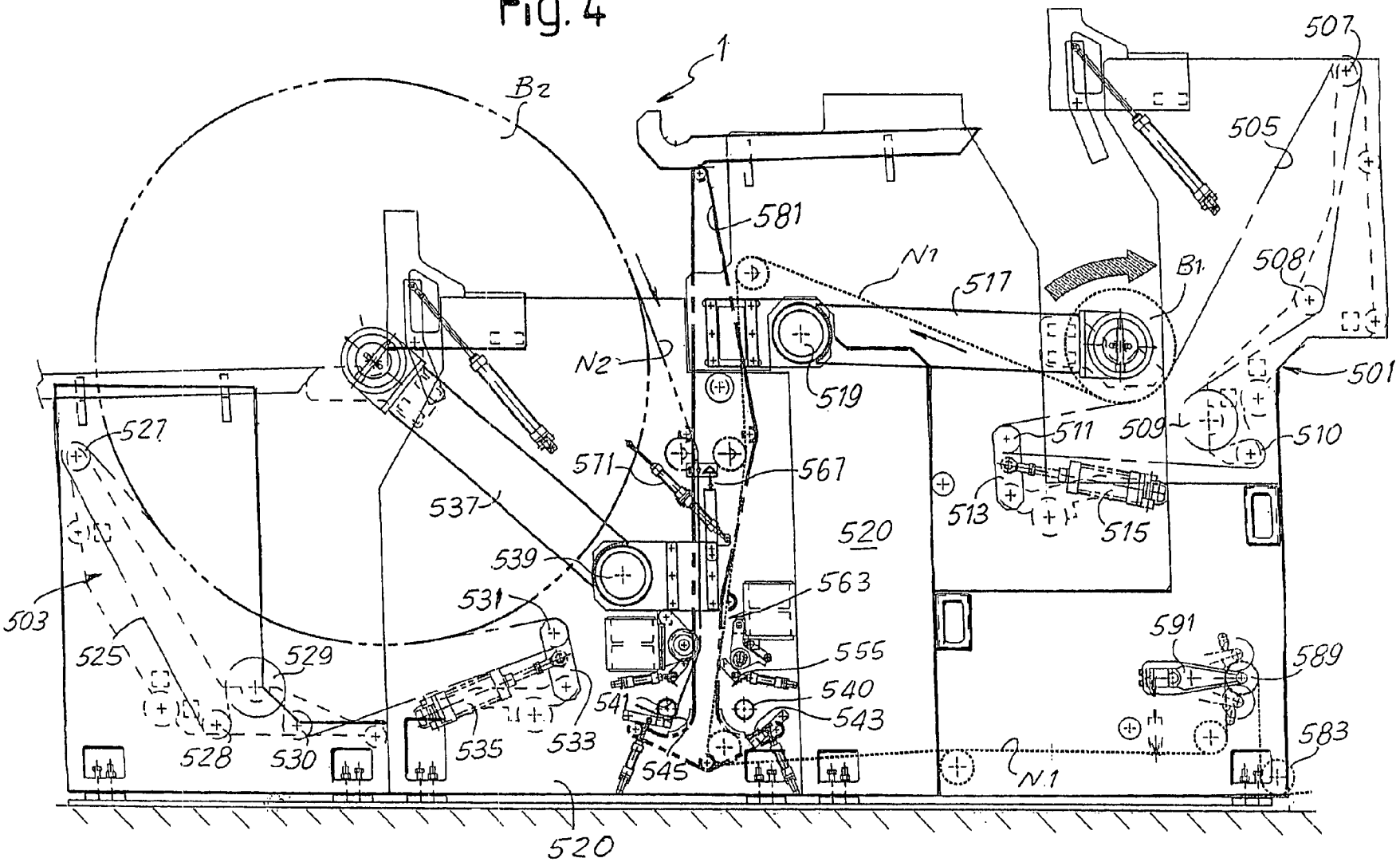
FIGS. 4, 5, 6 and 7 show an operating sequence in a different operating mode of the device.

In FIG. 4 it can be observed how the reel B1 is being unwound and has almost expired, while the reel B2 is standing by ready to deliver the material N2 wound thereon. The initial free end of the web material N2 of the reel B2 is applied, by means of the member 545, to the core 541 for the purposes described hereunder. Adhesion can be obtained by a double-sided adhesive tape applied to the core 541. Insertion of the web material N2 in the area in which the core and the pressure member 545 are located is facilitated by means of the insertion belt 581.

When the reel B1 is to be replaced with the reel B2 after said reel B1 has expired, angular acceleration of the reel B2 is firstly performed to take the peripheral speed thereof to essentially the same value as the expiring reel B1. If necessary, the latter can be decelerated to facilitate the reel replacement operation. However, feed of the web material is preferably never interrupted by stopping it completely, so that the entire production line continues to operate, although at a lower speed if required.

Figure 5:
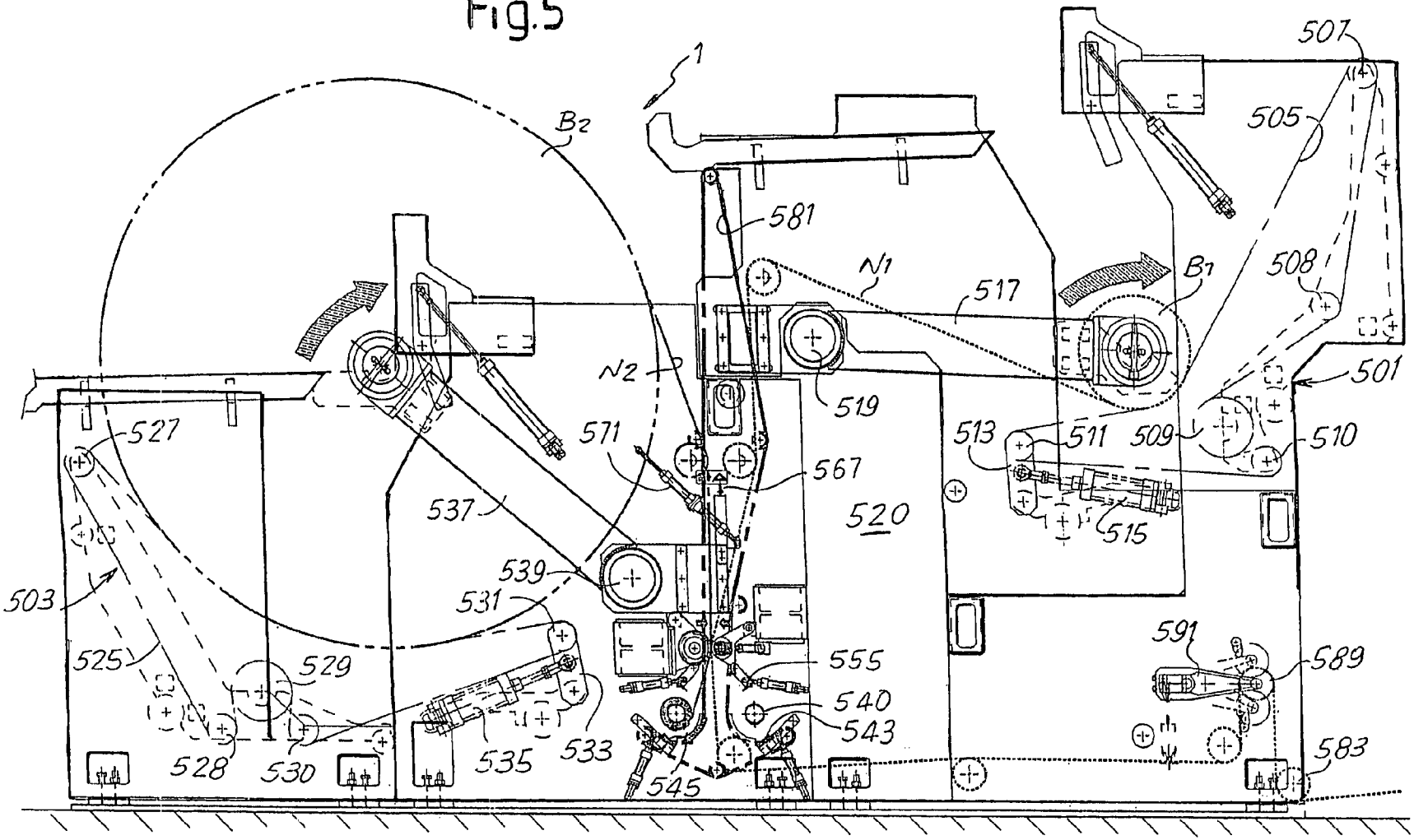

During the acceleration phase of the reel B2 the web material N2 which it delivers before splicing with the web material N1 is wound and accumulates around the core or spindle 541, which for this purpose is made to rotate by a motor (not shown). Once they have essentially reached the same speeds, the web materials N1 and N2 are spliced by means of the ply-bonding unit 563 which closes to press the two plies against each other and join them by ply-bonding. FIG. 5 shows the splicing phase. It is understood that splicing of the material N1 and N2 can also take place in another way, for example by providing a glue nozzle upstream of a pair of rollers which are closed to press the materials N1 and N2 together after applying glue therebetween.

Figure 6:
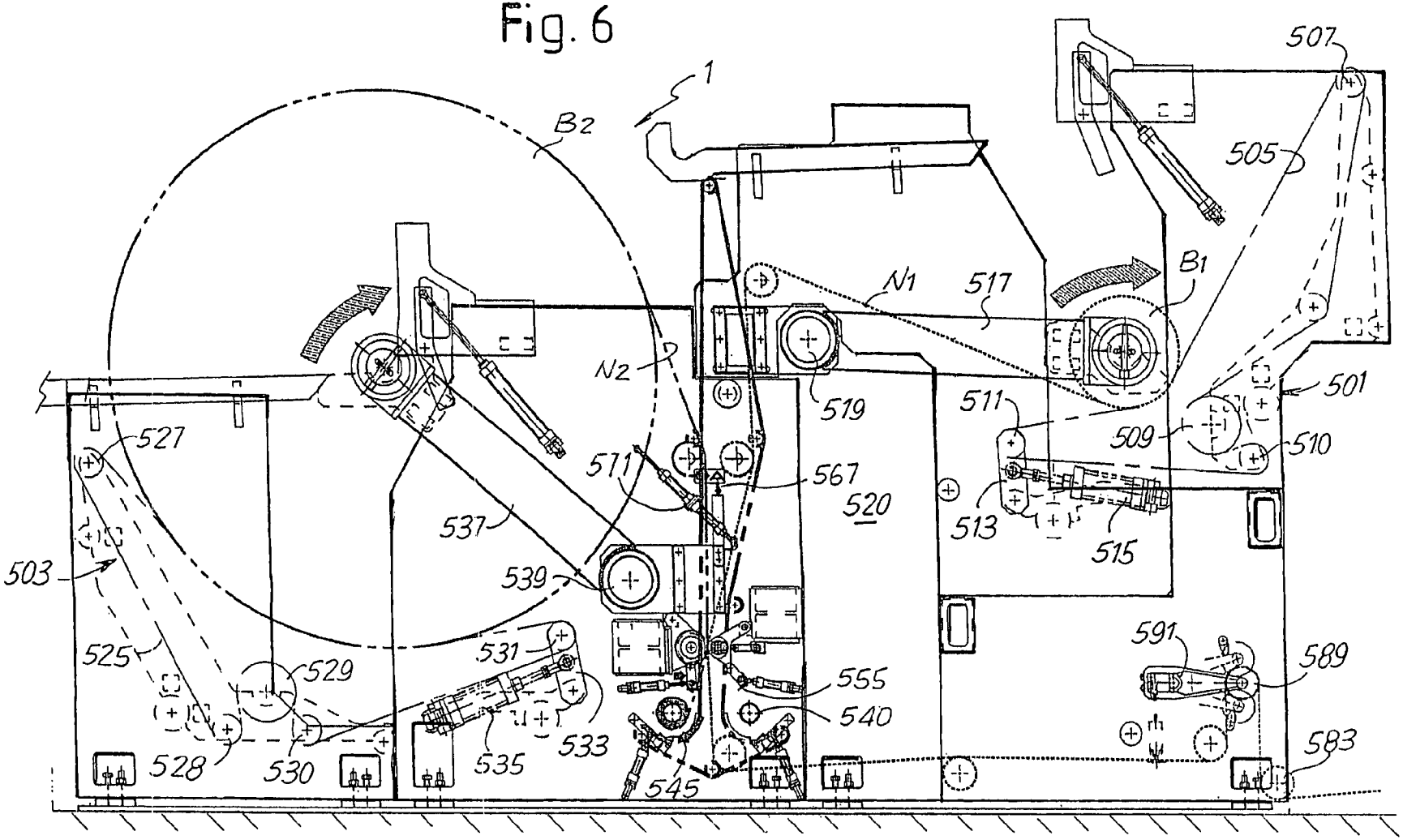

Once splicing has commenced, the cutting or severing member 557 is made to oscillate by means of the actuator 561 to cut the web material between the ply-bonding area and the winding area around the core 541. The instant of the cut is represented in FIG. 6. This operation allows separation of the initial portion of the web material N2 wound on the accumulator or accumulating member represented by the core 541, to then start to deliver the material N2 along the natural path thereof, around the roller 583 and from here towards the machines downstream of the unwinder 1.

At the same time or in a previous or subsequent instant, the web material N1 is severed upstream of the ply-bonding unit 563. Severing is performed by oscillating the other severing member 565 clockwise by means of the actuator 571 so that it interferes with the trajectory of the web material N1, thereby causing severing.

Figure 7:
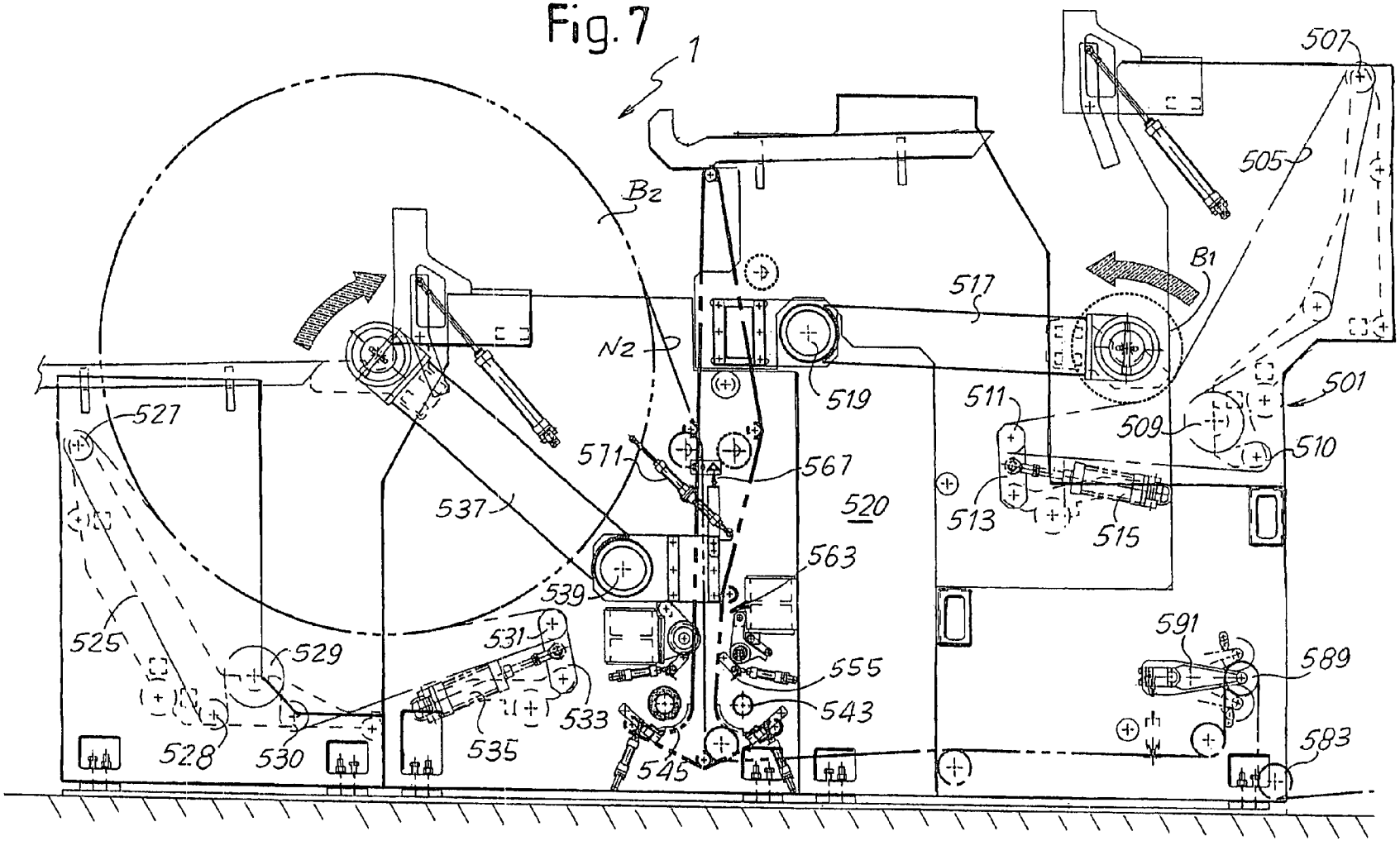

The tail of the web material N1 which is thus located between the expiring reel B1 and the severing member 565 is rewound by reversing the movement of the unwinding member 501 as shown in FIG. 7, in which the reel B2 is shown in its full delivery phase, with the ply-bonding device or unit 563 open again after having completed splicing of the materials N1 and N2. A certain amount of web material is wound around the core 541 and this is recovered together with the winding core 541 and recycled if required.

An exactly specular operating cycle is performed in the subsequent phase to replace the reel B2, once it has expired, with a new reel B1 positioned on the arms 517.

Figure 8A:
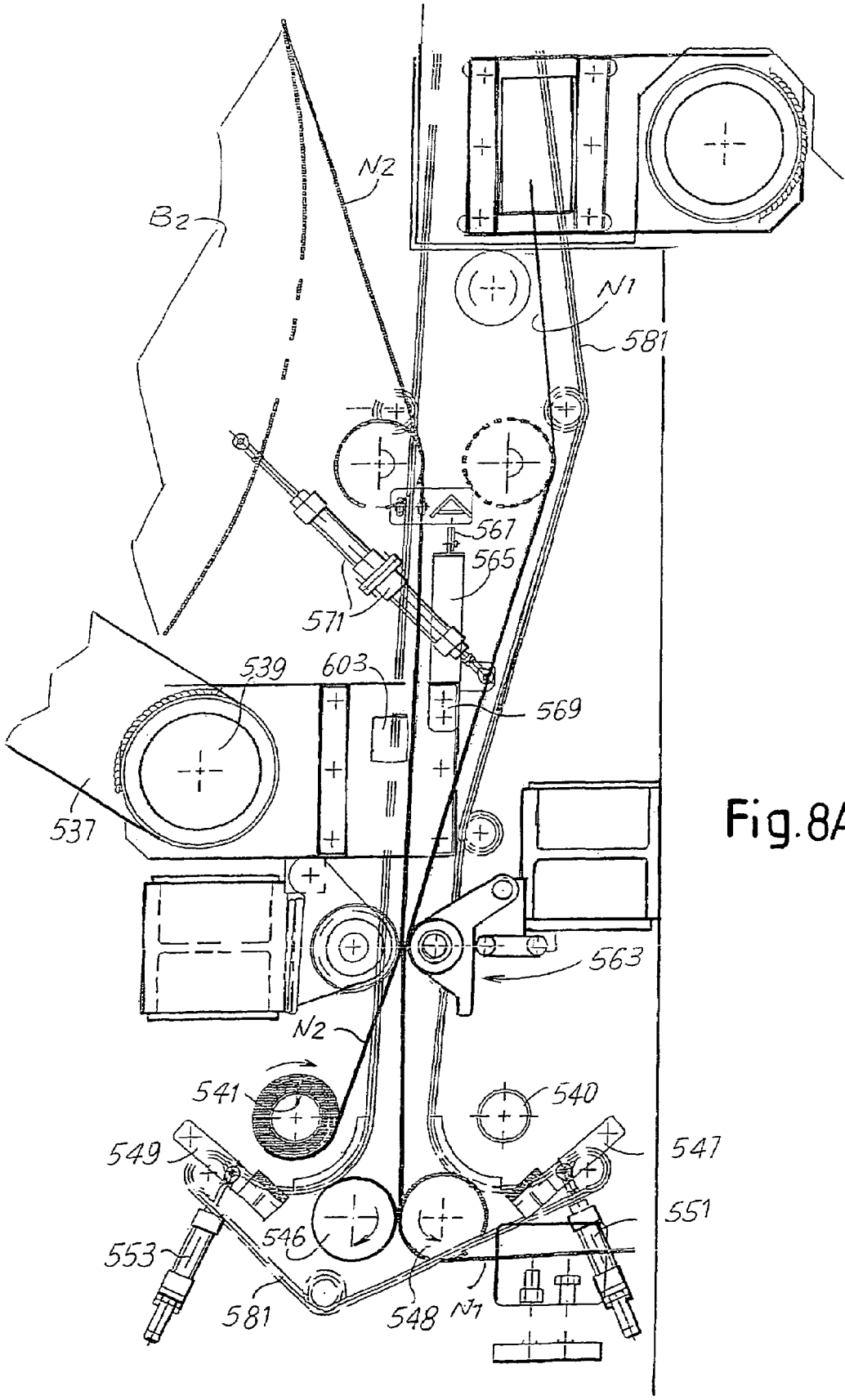
FIGS. 8A-8D show, in an enlargement similar to the one in FIG. 3, a variant of embodiment in an operating sequence.
Figure 8B:
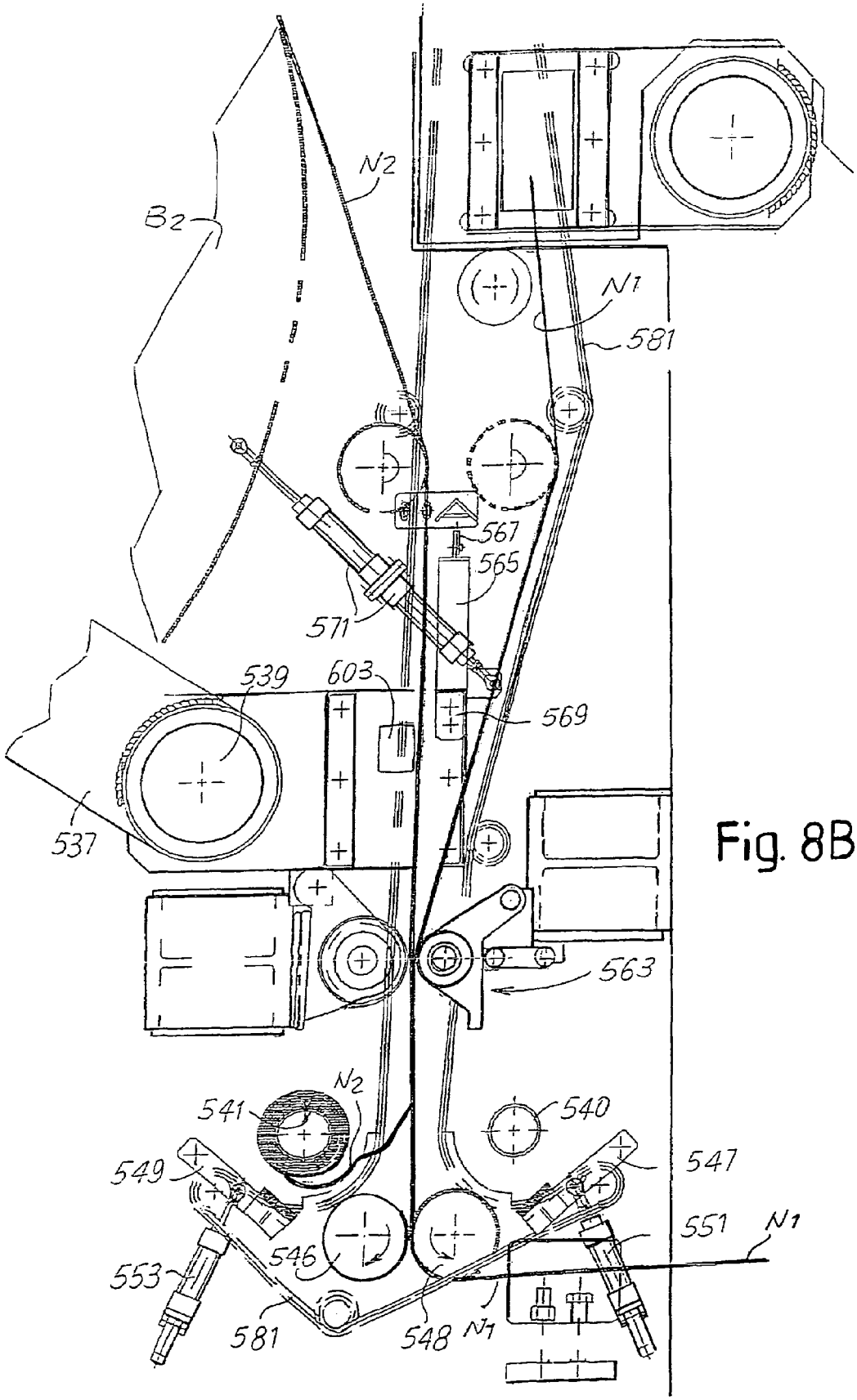
Figure 8C:
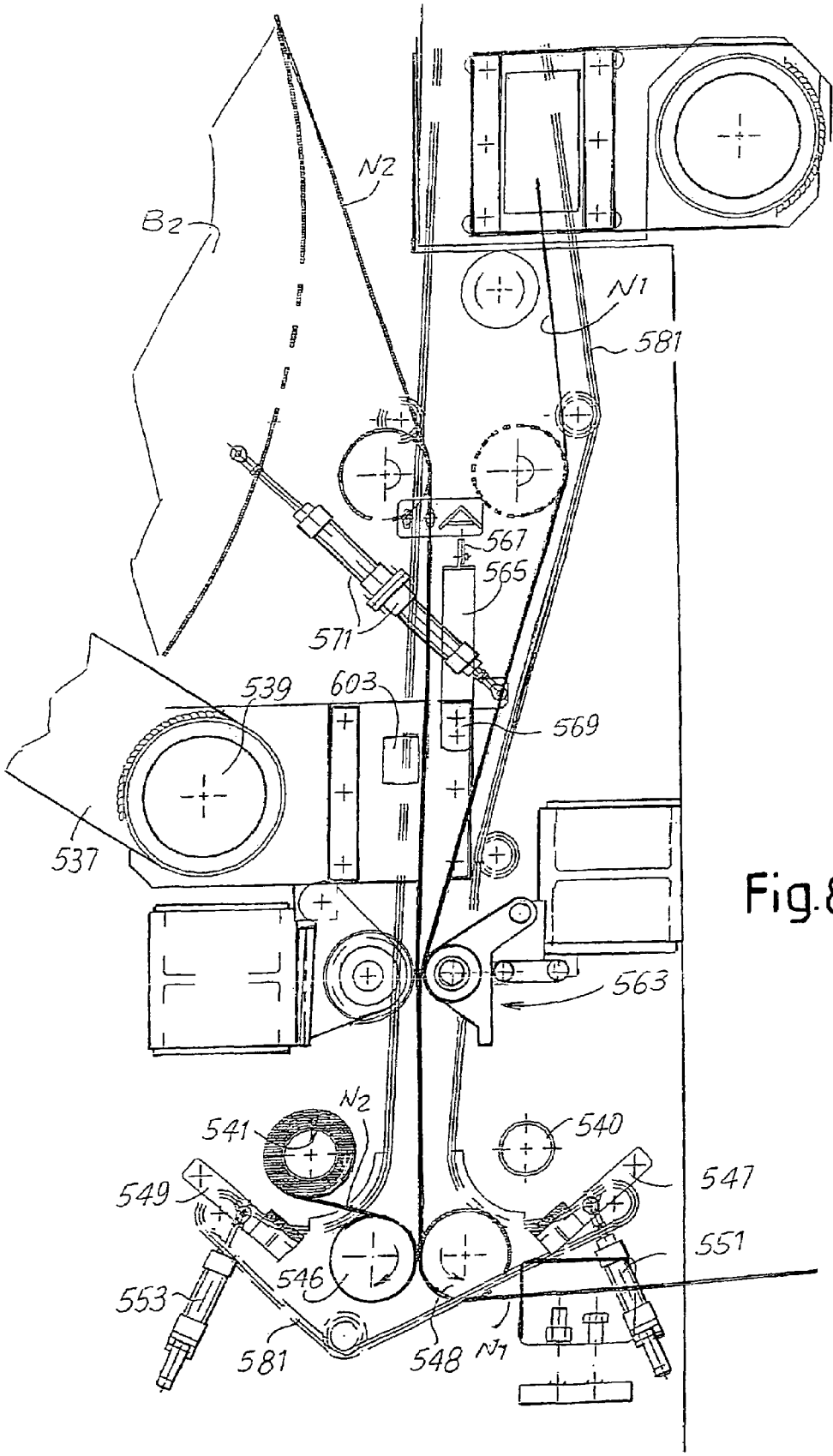
Figure 8D:
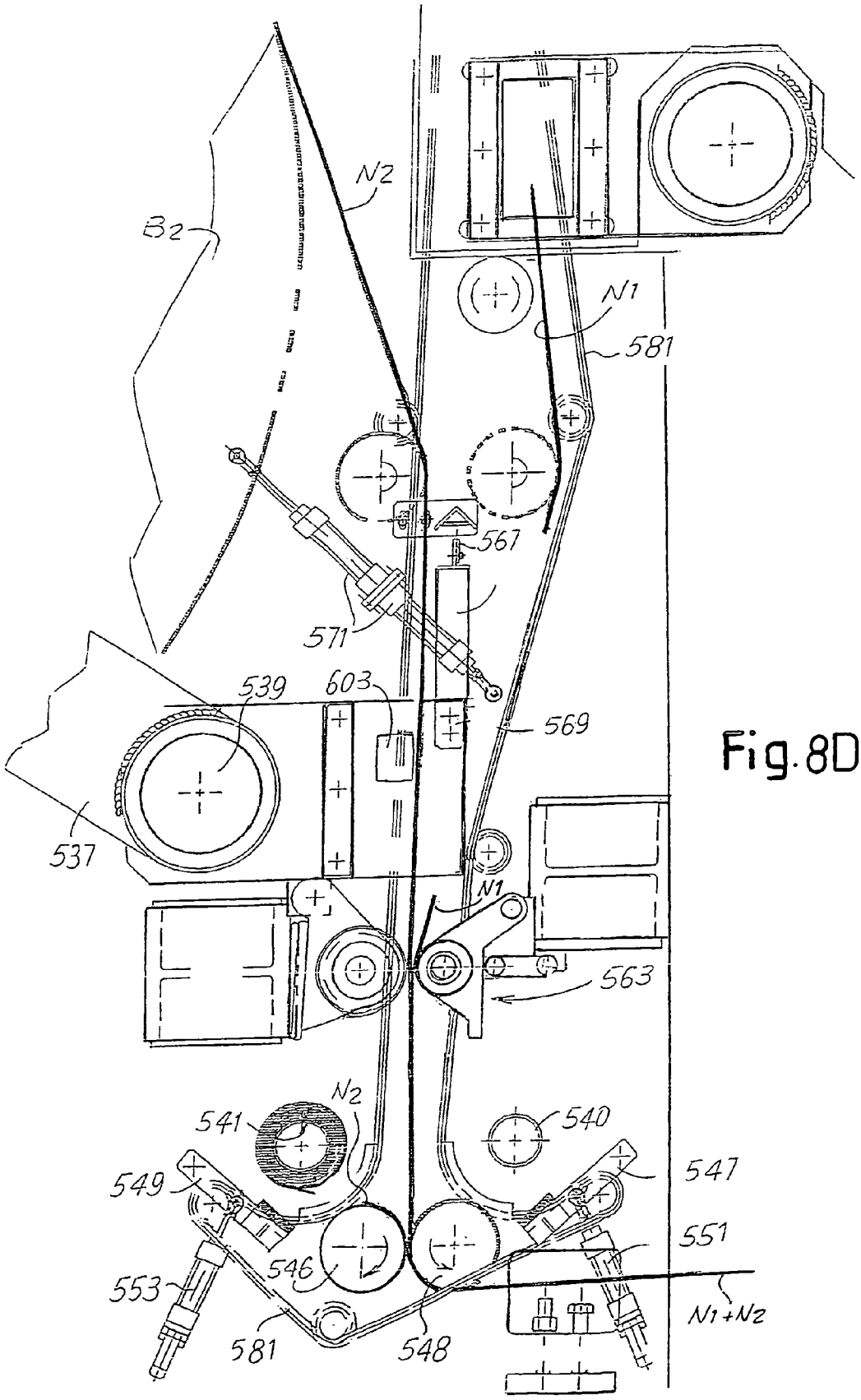

FIGS. 8A-8D show a modified embodiment of the device, with a different severing system of the web material in the case of automatic operation, namely, splicing of the web materials N1 and N2 at speed. In FIGS. 8A-8D the same numbers are used to indicate identical or equivalent parts to those in FIG. 3. The arrangement in FIGS. 8A-8D differs from the one in FIG. 3 essentially in two aspects: the cutting or severing members 555 and 557 and relevant actuators 559, 561 are missing. Moreover, a pair of rollers 546, 548 are disposed downstream of the ply-bonding unit 563, and used to sever the web material which starts to be delivered from a new reel (the material N2 delivered from the reel B2 in the automatic cycle shown in FIGS. 4 to 7). As the cutting or severing members 555, 557 are missing, cutting or severing of the material N2 when it has been spliced by the unit 563 with the material N1 and the material N2 must start to be delivered to the converting line fed by the unwinding device must start, is performed as follows. In FIG. 8A the web material N2 is wound around the core 541, while the material N1 continues to be delivered between the two rollers 546, 548. The two normally open rollers 546, 548, that is, not pressed against each other, have both been taken to the feed speed of the web materials N1, N2 and are moved towards each other to nip the material N1 in the nip formed therebetween. When the web material must be severed the core 541 is decelerated of stopped. As the material N2 continues to be delivered, it forms a loop or pocket (FIG. 8B) which is inserted (if necessary with the aid of air nozzles or suction systems) in the nip between the rollers 546, 548 (FIG. 8C). In practice, this operation can be synchronized with splicing performed by the ply-bonding unit 563, to ensure that the ply N2 is accompanied into the nip between the rollers 546, 548 by the web material N1. The difference in speed between the rollers 546, 548 on the one hand and the core 541 on the other causes tensioning and tearing of the material N2 between the nip formed by the rollers 546, 548 and the core 541 (FIG. 8D).

The system operates symmetrically when the web material N2 expires and must be spliced at speed with a web material N1 coming from a new reel B1 which has in the meantime been inserted in the unwinder.

One or both rollers 546, 548 can be coated in material with a high friction coefficient, such as rubber, to draw the web materials N1, N2. Alternatively, they can be embossing rollers, such as two rollers provided with protuberances and cavities meshing with each other, or one provided with protuberances and the other with a yielding rubber or similar coating. In another alternative they can form a ply-bonding or knurling unit. In this case the rollers 546, 548 cause splicing of the tail of the material N2 formed by tearing so that this portion of material does not obstruct the subsequent operations performed on the web material downstream of the unwinder.

Figure 9A:
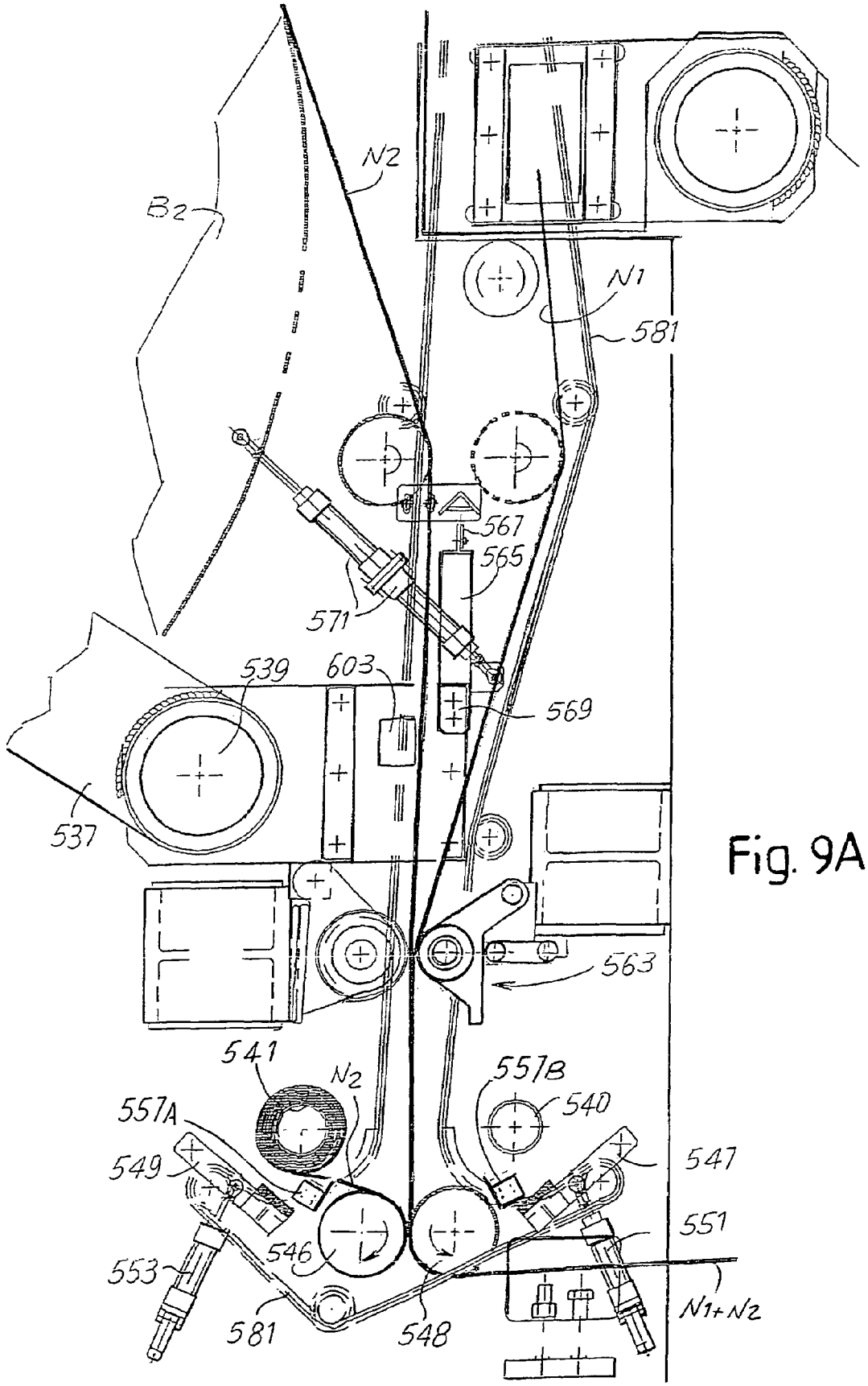
FIGS. 9A-9B show, analogous to FIGS. 8A to 8D, a further variant of embodiment with the relative operating sequence.
Figure 9B:
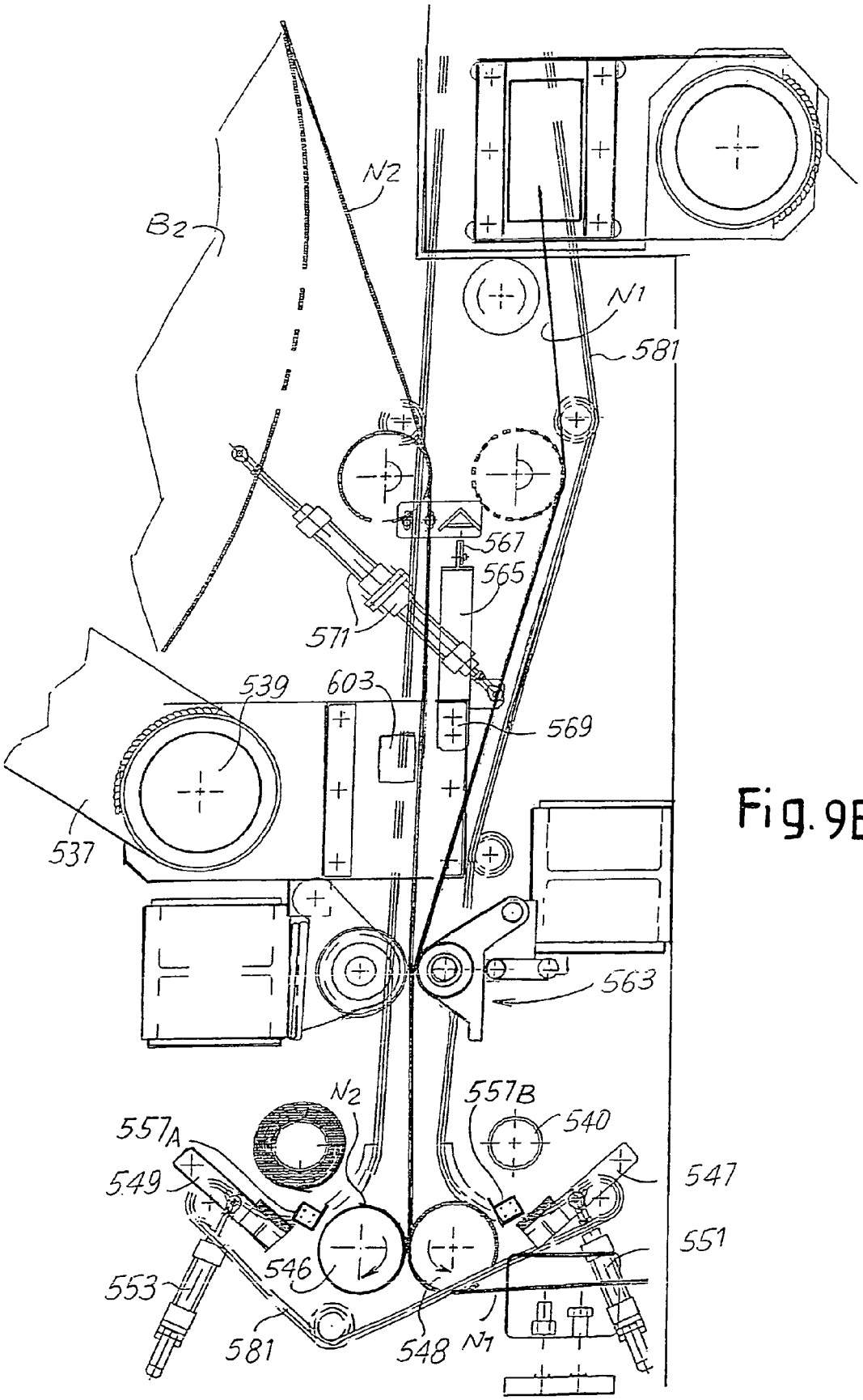

The sequence of FIGS. 9A and 9B shows a modified embodiment. The same numbers indicate identical or corresponding parts to those in FIGS. 8A-8D. In this solution the two cores 541, 540 forming the accumulation members or devices of the head portion of the web material are associated with blades 555A and 557A, which are fixed instead of oscillating like the blades 555 and 557. In this case the web material, which is nipped between the rollers 556 and 548, is pulled tight between the rollers and the core 541 or 540 and thrust against the relative blade causing it to be cut.

From the above description the unwinder 1 can operate in two distinct operating modes: an essentially automatic mode wherein an expired reel B1 is replaced with a new reel B2 by automatically splicing the two web materials N1 and N2 at speed; and a manual mode wherein one or more reels B1, B2 can be unwound simultaneously to feed the conversion line and wherein replacement of one or other of said reels when it has expired is performed manually by temporarily stopping both unwinding units 501 and 503. A third operating mode could involve the use of only one of the unwinding members. All the different possible operating modes are obtained with a relatively limited number of mechanical members and an extremely simple structure. The use of one or other operating modes is controlled by a microprocessor control unit or by any other adequately programmable control means. In any case, the two reels on the two unwinding members of the device 1 are unwound simultaneously for at least a certain length. When the device operates in manual mode, that is, in which splicing of the web materials occurs entirely with the machine at a standstill, unwinding of the reels is performed entirely in parallel, i.e. paying off the web always from both unwinding members, even if the two reels B1 and B2 do not expire at the same time and therefore are replaced at different times. When the device operates automatically splicing the web materials at speed, the two reels B1 and B2 in the device will deliver the web material, simultaneously only for a short period of time, which represents the transitory acceleration phase of the reel B2 which is to replace the expiring reel B1.

It is understood that the drawing purely shows an example provided as a practical demonstration of the invention, which may vary in forms and arrangements without however departing from the scope of the concept on which said invention is based.

The invention claimed is:

1. An unwinding device to unwind reels of web material, comprising:

a first unwinding member and a second unwinding member to simultaneously unwind a first reel and a second reel;

a splicing device to join together a first web material coming from said first reel and a second web material coming from said second reel;

a first accumulation member associated to said first unwinding member and a second accumulation member associated to said second unwinding member to accumulate the web material delivered from one of said first reel or said second reel before splicing with web material delivered from another one of said first reel or said second reel during a transitional acceleration phase of said one of said first reel or said second reel;

a first delivery path extending from said first unwinding member to said first accumulation member and a second delivery path extending from said second unwinding member to said second accumulation member, said first delivery path and said second delivery path extending across said splicing device;

a first path for the first web material and a second path for the second web material for simultaneous delivery of both said first web material from said first reel and said second web material from said second reel respectively towards a downstream machine, and when two reels are present, simultaneously on the first unwinding member and the second unwinding member and unwound in parallel and rotate simultaneously and deliver the web material concurrently for an entire unwinding cycle;

wherein said first unwinding member and said second unwinding member are arranged to alternatively:

either unwind one of said first reel and said second reel while maintaining another one of said first reel and said second reel in a standby condition and splice one of said first web material and said second web material to another one of said first web material and said second web material when said one of said first reel and said second reel requires replacement to deliver a single web material to said downstream machine;

or simultaneously unwind and deliver to said downstream machine both said first web material and said second web material.

2. The device as claimed in claim 1, wherein said first accumulation member and said second accumulation member are disposed downstream of the splicing device with respect to a direction of feed of the web material.

3. The device as claimed in claim 2, wherein at least a first take-up roller and a second take-up roller of the web material are disposed along said first path and said second path respectively.

4. The device as claimed in claim 3, wherein said first take-up roller and said second take-up roller are movable and arranged to control tension in a respective web material separately in the first path and in the second path.

5. The device as claimed in claim 1, wherein at least a first take-up roller and a second take-up roller of the web material are disposed along said first path and said second path respectively.

6. The device as claimed in claim 5, wherein said first take-up roller and said second take-up roller are movable and arranged to control tension in a respective web material separately in the first path and in the second path.

7. The device as claimed in one of claims 1 to 4, wherein said first path and said second path converge in a common downstream path.

8. The device as claimed in one of claims 1 to 4, further comprising a control unit constructed and arranged to control rotation of said first reel and said second reel to unwind said first reel and said second reel simultaneously for an entire unwinding operation or, alternatively, only during an initial reel changing phase, during which the second reel is made to rotate at a predetermined speed for reciprocal splicing of the first web material of the first reel and of the second web material of the second reel by said splicing device.

9. The device as claimed in claim 1, wherein each of said first accumulation member and said second accumulation member is constructed and arranged to accumulate web material delivered from the first reel supported by the first unwinding member with which the first reel is associated during an acceleration phase of the first reel by the first unwinding member before splicing of the first web material wound thereon with the second web material delivered from the second reel supported by the second unwinding member.

10. The device as claimed in claim 1, further comprising a retaining device of a tail of web material at an end of delivery of a respective one of said first reel and said second reel, said retaining device being associated with at least one of said first unwinding member and said second unwinding member, said web material being delivered to an alternative path.

11. The device as claimed in claim 10, wherein the retaining device of the tail of web material at the end of delivery of the respective one of the first reel and the second reel is associated with both of said first unwinding member and said second unwinding member.

12. The device as claimed in claim 1, further comprising a severing member to sever web material between the splicing device and a respective one of said first accumulation member and said second accumulation member, said severing member being associated with at least one of said first accumulation member and said second accumulation member.

13. The device as claimed in claim 1, further comprising two severing members, each of which is associated with one of said first accumulation member and said second accumulation member.

14. The device as claimed in claim 12 or 13, wherein said two severing members comprise oscillating blades.

15. The device as claimed in claim 12, wherein said severing member is single and arranged to sever web material accumulated on one of the first accumulation member or the second accumulation member.

16. The device as claimed in claim 12, wherein said severing member comprises a pair of rollers movable towards each other to nip web material passing therebetween.

17. The device as claimed in claim 16, wherein said severing member further comprises two fixed blades, each of said two fixed blades being associated with one of said first accumulation member and said second accumulation member.

18. The device as claimed in claim 1, further comprising at least one severing device disposed upstream of said splicing device to sever the first web material delivered from the first reel subsequent to splicing with the second web material coming from the second reel.

19. The device as claimed in claim 18, wherein said at least one severing device is constructed and arranged to sever web material delivered alternatively from the first reel or from the second reel.

20. The device as claimed in claim 1, further comprising a belt arranged to insert a head of the first web material of the first reel or of the second web material of the second reel towards the first accumulation member or the second accumulation member respectively.

21. An unwinding device to unwind reels of web material comprising:

unwinding members to unwind a first reel and a second reel;

a splicing device to join together a final end of a first web material coming from said first reel and an initial end of a second web material coming from said second reel;

a first feed path for advancing one of said first web material and said second web material, said first feed oath extending across said splicing device;

a second feed path for advancing another one of said first web material and said second web material, said first feed path and said second feed path being constructed and arranged to simultaneously feed and deliver said first web material and said second web material in parallel from said unwinding device to a downstream machine;

a control unit constructed and arranged to control rotation of said first reel and said second reel to unwind said first reel and said second reel simultaneously for an entire unwinding operation or, alternatively, only during an initial reel changing phase, during which the second reel is made to rotate at a predetermined speed for reciprocal splicing of the first web material of the first reel and of the second web material of the second reel by said splicing device.

22. The device according to claim 21, further comprising a first path and a second path for the first web material and the second web material delivered simultaneously from said first reel and from said second reel towards a downstream machine.

* * * * *

UNITED STATES PATENT AND TRADEMARK OFFICE

CERTIFICATE OF CORRECTION

PATENT NO. : 7,618,004 B2
APPLICATION NO. : 11/579584
DATED : November 17, 2009
INVENTOR(S) : Mauro Gelli et al.

It is certified that error appears in the above-identified patent and that said Letters Patent is hereby corrected as shown below:

Column 8,
Line 43, "is decelerated of" should read -- is decelerated or --.

Column 10,
Line 47, Claim 7, "claims 1 to 4" should read -- claims 1 to 6 --.

Column 10,
Line 50, Claim 8, "claims 1 to 4" should read -- claims 1 to 6 --.

Column 12,
Line 18, Claim 21, "first feed oath" should read -- first feed path --.

Signed and Sealed this

Fifteenth Day of June, 2010

David J. Kappos

David J. Kappos
*Director of the United States Patent and Trademark Office*